US005347610A

United States Patent [19]

Lee

[11] Patent Number: 5,347,610

[45] Date of Patent: Sep. 13, 1994

[54] SAFETY CONTROL SYSTEM FOR A CLOTHES WASHER INCORPORATING PRIMARY, SECONDARY, AND TERTIARY TEMPERATURE SENSORS

[75] Inventor: Hong Y. Lee, Kyungki-Do, Rep. of Korea

[73] Assignee: Samsung Electronics Co., Ltd., Suwon, Rep. of Korea

[21] Appl. No.: 990,242

[22] Filed: Dec. 14, 1992

[30] Foreign Application Priority Data

Jul. 9, 1992 [KR] Rep. of Korea ..... 92-12671[U]

[51] Int. Cl.[5] ..... H05B 1/02; F24H 1/00; D06F 39/04

[52] U.S. Cl. ..... 392/447; 68/12.03; 68/15; 134/105; 219/437; 219/508; 219/517; 392/451; 392/498

[58] Field of Search ..... 134/105–108, 134/57 D; 68/15, 16, 12.03; 392/441, 442, 444–449, 451–455, 497, 498; 219/437, 508, 517

[56] References Cited

U.S. PATENT DOCUMENTS 2,412,737 12/1946 Kercher ..... 219/517 X

FOREIGN PATENT DOCUMENTS 1250564 12/1960 France ..... 219/517

*Primary Examiner*—Anthony Bartis

*Attorney, Agent, or Firm*—Burns, Doane, Swecker & Mathis

[57] ABSTRACT

The boiling water washing machine provides a safety control device for a heater. The safety control device comprises a metal bracket sealingly mounted on a tub. On the top of the bracket the heater is contactedly mounted. On the inner of the bracket the thermistor is installed for initially detecting the temperature of the heater, and the thermostat is installed for controlling the heater when the thermistor cannot operate properly. At the brim of the metal bracket a fuse assembly is mounted. The fuse cuts off the electrical supply when excessive heat is transmitted through the metal bracket.

3 Claims, 2 Drawing Sheets

SAFETY CONTROL SYSTEM FOR A CLOTHES WASHER INCORPORATING PRIMARY, SECONDARY, AND TERTIARY TEMPERATURE SENSORS

BACKGROUND OF THE INVENTION

The present invention relates to a safety control system incorporated into a washing machine used for processing clothes with boiling or hot water, and particularly, to a safety control system in a boiling clothes washing machine for controlling the operation of the water heater when the water heater temperature detecting means malfunction.

FIG.1 illustrates a partial elevational side view of a boiling water clothes washing machine provided with a heater temperature detecting means and a wash water temperature detecting means according to the prior art. Heater 2 for boiling the wash water in a tub 1 is placed between the outer bottom surface of a spin basket 7 and the inner bottom surface of a tub 1. One underside portion of the heater 2 is placed in contact with the upper portion of a metal bracket 3 which is mounted in the inner bottom surface of the tub 1. Thermistor Th1 and thermostat 36 are mounted on the lateral interior surface of the metal bracket 3 such that thermistor Th1 and the thermostat 36 do not come into direct contact with the wash water in the tub 1 but so that they can detect the temperature of the heater 2. The operation of the heater 2 is thus controlled by the thermistor Th1 and the thermostat 36. Additionally, another temperature detecting means, i.e. a thermistor 6 and a thermostat 37 are mounted on the inner bottom surface of the tub 1 such that they are directly immersed in the water of the tub 2. The thermistor 6 and the thermostat 37 detect the temperature of the water and accordingly the operation of the heater 2 is controlled. In the system described above, the overheating of the heater 2 is prevented by the operation of the heater temperature detecting means, i.e. the thermistor Th1 and the thermostat 36. Further, when the heater temperature detecting means is not operational, the water temperature detecting means, i.e. the thermistor 6 and the thermostat 37, operate to cut off electricity to the heater. Therefore, the overheating of the heater can be prevented.

However, in the system described above, when the heater temperature detecting means malfunction, it takes additional time for the water temperature detecting means to detect that the temperature of the water is becoming overheated. During the time delay, the inner bottom surface of the tub can become distorted due to the excessive heat generated by the heater which is mounted adjacent thereto. Furthermore, overheating of the heater increases the possibility of causing a fire in the washing machine components.

It is an object of the present invention to provide a safety control system having a fuse assembly in order to solve the above problems in a boiling water clothes washing machine.

It is another object of the present invention to provide a safety control system in a boiling water clothes washing machine to increase the user's confidence that the risk of fire is reduced.

It is another object of the present invention to provide a safety control system in a boiling water clothes washing machine that will cut off the flow of electricity to the water heater if excessive heat is conducted through the heater support member when the initial heater temperature detecting means malfunction.

SUMMARY OF THE INVENTION

In order to achieve these objects, the safety control system comprises a heater mounted horizontally adjacent to a inner bottom surface of a tub, and a metal heater supporting member mounted in the tub and placed in contact with the heater.

Further, the safety control system comprises an initial heater temperature detecting means, mounted on the rear of the supporting member, for controlling the operation of the heater, and a secondary heater temperature detecting means, mounted on the rear of the supporting member, for controlling the operation of the heater in case the initial heater temperature detecting means malfunction.

Furthermore, the safety control system comprises a third heater temperature detecting means, mounted on the rear of the supporting member, for controlling the operation of the heater by sensing the heat conducted through the metal supporting member in the event that the secondary heater temperature detecting means malfunction.

DETAILED DESCRIPTION OF A PREFERRED EMBODIMENT OF THE INVENTION

Figure 1:
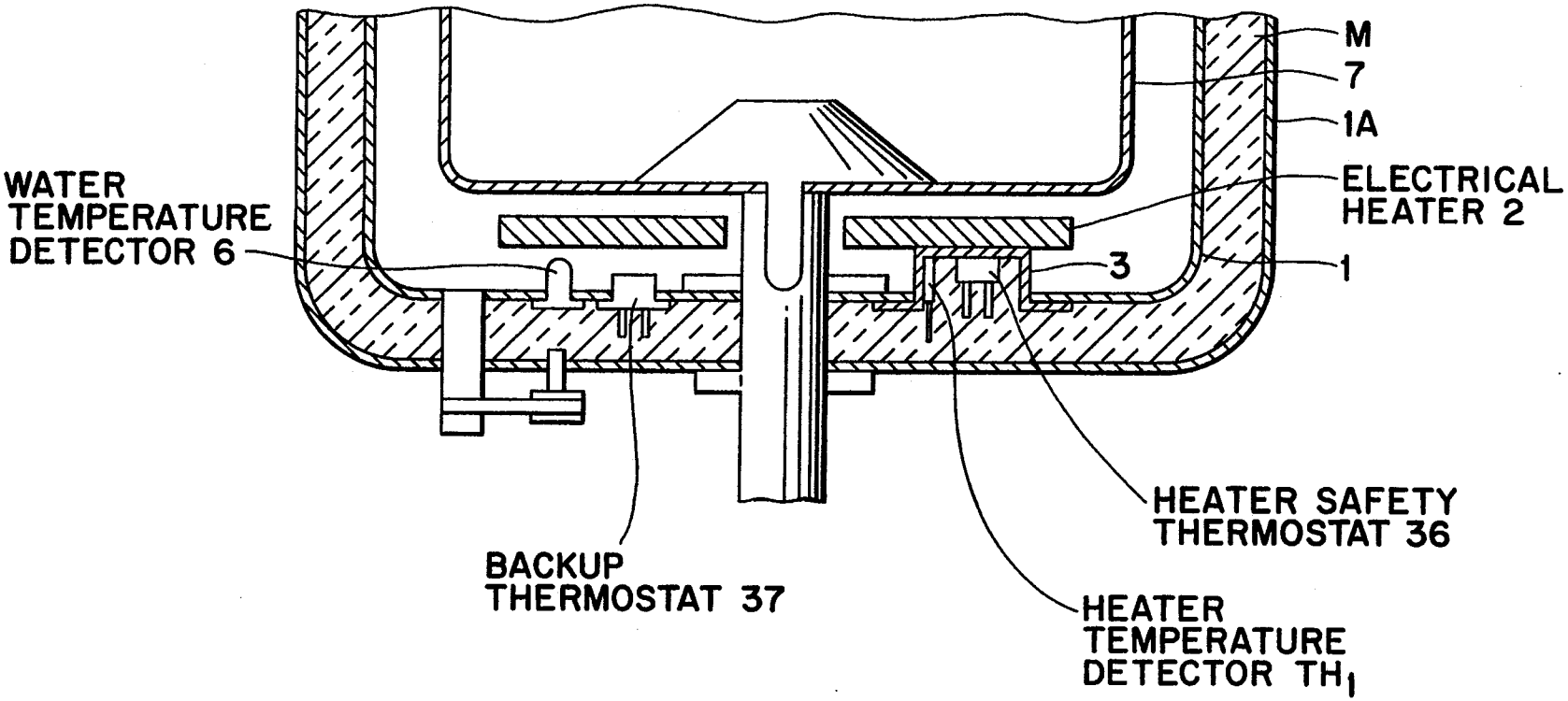
FIG. 1 (PRIOR ART)
FIG. 1 is a schematic vertical section through the mounting of a number of safety devices on the inner bottom surface of a tub according to the prior art.
Figure 2:
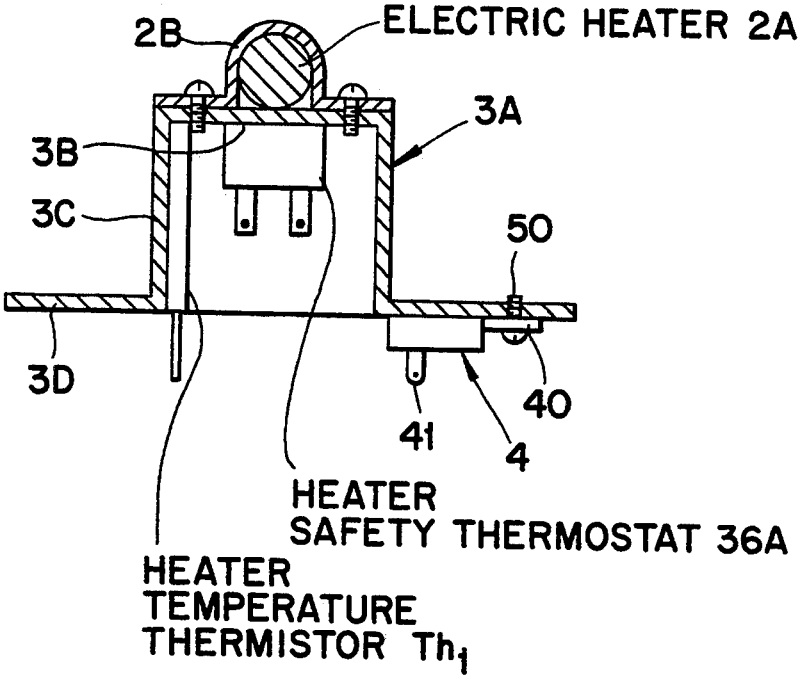
FIG. 2 is a sectional view through a safety control system according to the present invention.
Figure 3:
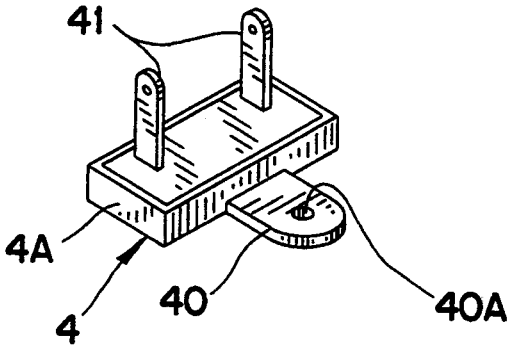
FIG. 3 is a perspective view of a fuse assembly of the safety control system of FIG.2.

As shown in FIG. 2, the safety control system comprises a heater 2A horizontally mounted between the outer bottom surface of a spin basket 7 and the inner bottom surface of a tub 1. A thermally insulative material M is disposed between the tub 1 and an outer casing 1A. The heater 2A is adapted to be attached to the top wall of a bracket 3A by a "U" clamp 2B. The bracket 3A is shaped in the form of a hat, and is made of brass in order to efficiently transmit the heat of the heater 2A. At the vertical internal wall 3C of bracket 3A a primary temperature detector in the form of a thermistor Th1 is mounted to initially detect the temperature of the heater 2A. The detecting head of the thermistor Th1 is located adjacent to the underside of the upper flat portion 3B of the bracket 3A and is bonded thereto by epoxy resin. A thermostat 36A is attached to the central portion of the underside of the upper flat portion 3B of the bracket 3A where the temperature of the heater 2A is most easily detected. An aluminum sheet may be inserted between the thermostat 36A and the bracket 3A in order to efficiently transmit the heat of the heater 2A. A fuse assembly 4 is mounted at the under surface of a brim 3D of the bracket 3A. The fuse assembly 4 provides a body 4A which is formed in a rectangular shape. A fuse (not shown) is bonded by epoxy resin in the body 4A in the same manner as the thermistor Th1. An electrical lead is connected to each end of the fuse and each lead is connected to a male prong 41 which extends from the body 4A. The fuse contains a thermal pellet which separates upon reaching a predetermined temperature. The fuse assembly 4 further provides an affixing plate 40 which protrudes from one side of the body 4A. An attaching hole 40A is formed at the central portion of the affixing plate 40, and the fuse assembly 4 is securely mounted to the brim 3D by a bolt 50 through the hole 40A.

When installed, the safety control system will operate as follows:

During a first stage of the water boiling mode, the temperature of the activated heater 2A is initially detected by the thermistor Th1. The signal generated by the thermistor Th1 is sent to a microcomputer (not shown) so as to control the operation of the heater 2A. However, in the event that the thermistor Th1 cannot operate properly, the heater 2A is activated continuously with the result that the temperature of the heater increases. The increasing heat is detected by the thermostat 36A. The thermostat 36A, which is interconnected to the heater 2A and power source in series, temporarily interrupts the power source upon reaching a predetermined temperature. If the thermostat 36A malfunctions, electricity is continuously supplied to the heater 36A. The excessive heat is transmitted through the upper flat portion 3B, the vertical wall 3C and the brim 3D of the metal bracket 3A. Thus, the heat of the brim 3D is transmitted to the body 4A of the fuse assembly 4. The solid state thermal pellet, which is inserted between the ends of the leads embedded in the fuse, is melted such that the electric supply to the heater 2A is cut off.

Therefore, even if both the thermistor and the thermostat malfunction, the electric flow to the heater is still cut off and the distortion of the tub and the possibility of fire in the components of the washing machine are prevented. This additional safety feature increases the user's confidence in the boiling water clothes washing machine.

What is claimed:

1. A boiling water clothes washing machine comprising:

a tub having a bottom surface therein, a metallic support plate mounted adjacent said bottom surface, a heater mounted in direct contact with an upper side of said support plate, and control means for controlling the temperature of said heater, comprising:

a primary heater temperature detecting means comprising a thermistor mounted to an underside of said support plate for detecting the heater temperature conducted through said support plate, a secondary heater temperature detecting means comprising a thermostat mounted to said underside for detecting the heater temperature conducted through said support plate, and a third heater temperature detecting means comprising a fuse mounted to said underside for detecting the heater temperature conducted through said support plate, said control means constituting means for controlling the temperature of said heater in response to a heater temperature detected by said thermostat in the event of a malfunction of said thermistor, and controlling the temperature of said heater in response to a heater temperature detected by said fuse in the event of a malfunction of both said thermistor and said thermostat.

2. A boiling clothes washing machine according to claim 1, wherein said thermostat and said fuse each include downwardly projecting plug-in prongs, said plug-in prongs of said thermostat extending parallel to said prongs of said fuse to enable said thermostat and said fuse to be plugged-in in response to a downward motion of said support plate.

3. A boiling water clothes washing machine according to claim 2, wherein said support plate is hat shaped and includes a top wall, a substantially vertical wall depending downwardly from an outer edge of said top wall and a brim wall extending substantially horizontally from a lower edge of said substantially vertical wall, said thermistor and said thermostat situated beneath said top wall, and said fuse situated beneath said brim wall.

* * * * *